US009885184B2

(12) United States Patent
Gomes

(10) Patent No.: US 9,885,184 B2
(45) Date of Patent: Feb. 6, 2018

(54) STUCCO CRACK REDUCTION AT CORNERS

(71) Applicant: Harold Furtado Gomes, San Juan Bautista, CA (US)

(72) Inventor: Harold Furtado Gomes, San Juan Bautista, CA (US)

( * ) Notice: Subject to any disclaimer, the term of this patent is extended or adjusted under 35 U.S.C. 154(b) by 0 days.

(21) Appl. No.: 15/331,170

(22) Filed: Oct. 21, 2016

(65) Prior Publication Data

US 2017/0037638 A1 Feb. 9, 2017

Related U.S. Application Data

(63) Continuation-in-part of application No. 29/536,176, filed on Aug. 13, 2015, now Pat. No. Des. 788,944, which is a continuation-in-part of application No. 29/477,998, filed on Dec. 30, 2013, now Pat. No. Des. 739,039, which is a continuation-in-part of application No. 13/769,536, filed on Feb. 18, 2013, now Pat. No. 8,615,950.

(51) Int. Cl.
*E04F 13/06* (2006.01)

(52) U.S. Cl.
CPC ..... *E04F 13/06* (2013.01); *E04F 2013/063* (2013.01)

(58) Field of Classification Search
CPC ..... E04F 13/06; E04F 2013/063; E04F 2013/061; E04G 23/0203
USPC ..... 52/254–256, 514, 514.5, 741.3, 741.41, 52/443, 454; 428/80, 131
See application file for complete search history.

(56) References Cited

U.S. PATENT DOCUMENTS 1,355,756 A 10/1920 Earley
1,454,042 A * 5/1923 Curtis ..... E04F 13/06 52/255
1,835,587 A * 12/1931 Baum ..... E04F 13/06 49/504
1,979,701 A * 11/1934 Merryweather ..... E04F 13/04 52/85
2,189,216 A * 2/1940 Mathias ..... E04F 13/06 49/504

(Continued)

FOREIGN PATENT DOCUMENTS

DE 29611225 U1 10/1997
WO WO 2015026244 A1 * 2/2015 ..... E04F 17/08

OTHER PUBLICATIONS

Crack Policy, Technical Bulletin 4, Plaster Counsel (May 2008) 2402 Vista Nobleza, Newport Beach CA 92660.

(Continued)

*Primary Examiner* — Theodore Adamos
(74) *Attorney, Agent, or Firm* — Steven A. Nielsen; www.NielsenPatents.com

(57) ABSTRACT

Stucco cracks at doors and windows are reduced or eliminated by use of a corner element fastened at a corner juncture before stucco coats are applied. The disclosed corner element spreads out or evenly dissipates differential movement or buckling often occurring at exterior corner junctures. The corner element may comprise various concentric circle attributes useful in stopping or reducing cracks in stucco and related building materials. The corner element embodiments may be secured at window and door corner areas and then integrated with traditional stucco applications.

11 Claims, 22 Drawing Sheets

(56) References Cited

U.S. PATENT DOCUMENTS

| | | | | |
|---|---|---|---|---|
| 2,218,731 | A * | 10/1940 | Harris | F21V 21/04 220/3.4 |
| 2,442,929 | A | 6/1948 | Marino | |
| 4,490,953 | A | 1/1985 | Meola | |
| 4,651,488 | A | 3/1987 | Nicholas | |
| 5,699,638 | A | 12/1997 | Maylon | |
| 5,761,866 | A * | 6/1998 | Maylon | E04F 13/06 156/258 |
| 5,820,958 | A | 10/1998 | Swallow | |
| 6,131,867 | A | 10/2000 | Mallek | |
| 6,231,949 | B1 | 5/2001 | Hoffmann | |
| 6,378,263 | B1 * | 4/2002 | Sobers | E04G 23/0203 52/443 |
| 6,601,361 | B2 | 8/2003 | Seibert | |
| 6,957,896 | B2 * | 10/2005 | Burgess | F21S 8/026 362/147 |
| 7,874,123 | B2 * | 1/2011 | Maziarz | 52/741.3 |
| 8,024,903 | B2 | 9/2011 | Riggs | |
| 8,511,867 | B1 * | 8/2013 | Tam | F21S 8/026 362/147 |
| 8,615,950 | B1 * | 12/2013 | Gomes | E04F 13/04 52/255 |
| 8,845,145 | B1 * | 9/2014 | Tam | F21S 8/026 362/364 |
| 2003/0215603 | A1 | 11/2003 | Lee | |
| 2004/0168387 | A1 | 9/2004 | Nelson | |
| 2004/0177572 | A1 * | 9/2004 | Burgess | F21S 8/026 52/220.8 |
| 2006/0156639 | A1 * | 7/2006 | Allen | E04F 13/06 52/58 |
| 2008/0141602 | A1 * | 6/2008 | Allen | E04F 13/06 52/302.1 |
| 2008/0196340 | A1 * | 8/2008 | Smythe | E04F 13/06 52/287.1 |
| 2013/0042539 | A1 * | 2/2013 | Burns | E04B 1/38 52/27 |
| 2016/0201325 | A1 * | 7/2016 | Moore | E04F 17/08 52/220.8 |

OTHER PUBLICATIONS

Base and Mesh Systems for Crack Reduction, Stucco Manufacturers Association (Mar. 2011) Newport Beach CA.

Technical Bulletin 107, Division 9 Finishes, Stucco and Plaster , revised Dec. 10, 2009 Merlex Stucco Inc, Orange CA.

* cited by examiner

STUCCO CRACK REDUCTION AT CORNERS

RELATED PATENT APPLICATIONS AND INCORPORATION BY REFERENCE

This utility patent application is a continuation in part of design patent application Ser. No. 29/526,176 filed on Aug. 13, 2015 which is a continuation in part application Ser. No. 29/477,998 filed on Dec. 30, 2013, now U.S. Pat. No. D739039, which is a continuation in part of application Ser. No. 13/769,536 filed on Feb. 18, 2013, now U.S. Pat. No. 8,615,950. These related patent applications and patents are incorporated herein by reference and made part of this utility application as if fully set forth herein. Moreover, the inventor incorporates herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION (1) Field of the Invention

The invention generally relates to means and methods of preventing or reducing stucco cracks at door and window corners. More specifically, disclosed embodiments include corner elements or work pieces that integrate into a stucco installation and then evenly dissipate differential building movement.

(2) Description of the Related Art

Lath and stucco material combine to form an integral unit. First, walls of a structure are waterproofed during the lathing process with two layers of grade D paper or equivalent. Next, a metal lath or chicken wire is installed and secured with 1¼" staples or other appropriate fasteners with the intended purpose of providing an ideal surface to support the plaster material. Stucco usually comprises a three coat system with a thickness of ⅞" and is applied in the following sequence: scratch coat, brown coat and finish coat. Stucco is applied as a wet cementitious material that may crack during the drying process, or more often may crack as a result of building settlement or earth movement. Cracks most often develop at or near window and door corners where building movements become unevenly dispersed.

The prior art of control joints on exterior stucco walls is often used in an effort to minimize cracks in large or long stucco panels. Although not intentionally created for this purpose, control joints can also be used at doors and windows. However, control joints add time and expense during the stucco installation process adding several hours of labor per control joint to ensure proper installation. Control joints are visible upon completion of the stucco system and may reduce the design appeal of the stucco, thereby deterring some builders or architects from using stucco. Thus, control joints represent a shortfall in the art.

The prior art often resorts to a synthetic material used in acrylic finish coats which may stretch to some extent with building movement in an effort to reduce the likelihood of hairline cracks. Unfortunately, exterior acrylic finish coats often fail to exhibit the necessary flexibility to remain intact since most structural cracks develop in the scratch coat and move outward toward the finished surface. Therefore, the superficial nature of acrylic finishes alone cannot hide or prevent most structural cracks. Consumers are also discouraged from incorporating an acrylic finish application into a stucco system due to the high cost associated with synthetic material.

More recently, the prior art involving new base and mesh systems have been advocated by various stucco trade organizations that employ polymer-modified coatings which are applied over the brown coat. Such solutions deal with the general field of stucco walls and teach away from specially addressing door or window corners. It is important to note that using a reinforcing fiber mesh embedded in a base coat is very costly, since it requires another coat of material to be applied over the entire structure. This option is often presented to customers by plastering contractors, although due to the additional time and cost associated with this system, it is usually declined. When accepted, the success of the mesh system is most effective in controlling minor cracks on large, uninterrupted surfaces and not at locations of most stress, specifically openings with square corners. See Base and Mesh Systems for Crack Reduction (March 2011) Stucco Manufactures Association, Newport Beach, Calif.

U.S. Pat. No. 1,355,756 issued on Oct. 12, 1920 to Earley is entitled "Flexible Joint for Stuccoed Buildings" discloses a spacer system to create an air space near doors and windows to allow surrounding stucco work to move without directly pressing upon stucco applied over door or window joints. The product is very similar to a casing bead around a frame, in that it functions more as a plaster stop and does not distribute the concentration of stress that accumulates and is released at the corners of windows and doors; thus cracks still form.

U.S. Pat. No. 4,651,488 issued on Mar. 24, 1987 to Nicholas et al is entitled "Expansion Joint for Plaster Walls" and discloses a unitary extruded plaster screed expansion joint system to reduce stucco cracks.

U.S. Pat. No. 5,699,638 issued on Dec. 23, 1997 to Maylon is entitled "Stucco Arch Casing Bead" and discloses an arch casing bead with a mounting flange and other features to facilitate the construction of stucco archways. Maylon fails to teach or consider the reduction of stucco cracks as Maylon is used to create a smooth surface for aesthetic and architectural purposes. The structure of Maylon would not work for reducing stucco cracks, but is merely used as a mold system.

U.S. Pat. No. 5,820,958 issued on Oct. 13, 1998 to Swallow discloses an elastic membrane with a pair of parallel strips. Swallow presents an interior cover-up adhesive to cover interior cracks prior to application of spackle or dry wall mud. Swallow merely spans both ends of a drywall repair and fails to consider the issue of preventing future cracks on stucco. The physical device of Swallow bears no resemblance to the disclosed embodiments.

U.S. Pat. No. 7,874,123 issued on Jan. 25, 2011 to Mariarz is entitled "Stop Bead for Separating Stucco Material from a Frame of a Window or Door" and discloses a slight variation to the traditional L-Bead system used to reduce the time and cost of applying stucco near a door or window. Here again, no corner provisions are considered, as the Mariarz disclosure is concerned with the speed of stucco application and not the reduction of subsequent cracks. Thus, there is a long felt need in the art for the embodiments of the present invention.

BRIEF SUMMARY OF THE INVENTION

The present invention overcomes shortfalls in the related art by presenting an unobvious and unique combination, configuration and use of circular corner systems or corner elements that reduce stucco cracking often caused by building settlement or building movement, especially when such movement occurs at corner construction components. While the prior art teaches away from individual treatment of each door and window corner, the present invention focuses on each corner and eschews the prior art's penchant for long control joints. The present invention provides solutions to prevent stress cracks at corners of windows and doors, which has been neglected by prior art. The disclosed implements are easy to fasten and to integrate into typical stucco installation. The disclosed implements do not interfere with a traditional stucco installation and application since the disclosed implements may be embedded in the scratch coat and hidden from view. The disclosed embodiments increase the appeal of stucco by reducing structural cracks and increasing consumer satisfaction.

The present invention overcomes shortfalls of the prior art by radially dispersing building movement caused by the oppositional forces exerted upon vertical and horizontal members of door and window frames. The prior art recognizes but yet fails to effectively address the fact that during building movement, door and window frames will buckle or move outwardly at corner junctures causing an uneven displacement of the framing members within the stucco system. In the prior art, such uneven or differential displacement of framing members pulls apart the integrated stucco, causing unsightly stucco cracks.

There is a long standing and pervasive problem associated with stress cracks in stucco. Cracks can occur at any location within a stucco system, but most commonly originate at the 90 degree corners of openings that are used for the installation of windows and doors; it is at these points that the greatest concentration of stress is released. Since there is a greater predisposal for the formation of structural cracks at these corner locations, the presently disclosed embodiments have been created to evenly dissipate corner component movements and hence reduce stucco cracks.

The present invention overcomes shortfalls in the art by using and producing a circular corner element (and corner element variations) that provides additional strength to stucco at each window or door corner, dissipates displacement of stucco movement that spans to either side of a door or window corner, separates movement of framing members from stucco at corners, provides a flexible back bone to stucco at corners, provides a flexible contact to either side of a corner and provides other advantages and attributes as described and illustrated herein.

Disclosed circular corner elements may comprise circular voids that help to more evenly disperse stucco movement around either side of a corner, in stark contrast to the prior art wherein moving stucco strikes a horizontal and/or vertical corner framing member, causing the stucco to heave and crack. The circular voids may be positioned in radial form, starting from a center circular void and positioned outwardly in the form of concentric circles or other forms. The length of the circular voids may be varied and/or staggered so as to allow a circular corner element to flex in a myriad of shapes so as to further dissipate and displace the movement of stucco and/or building components.

Disclosed circular corner elements may comprise outer perimeter areas that may be used as fastener or attachment areas to provide secure attachment to the building envelope or other substraight. But, the disclosed corner elements may be fastened at any part or area. A raised top surface or crown section of a corner element may add material to the component and height to the component and assist in absorbing, deflecting and dissipating stucco movement and/or building movement.

Disclosed circular corner elements may comprise corner receiving areas which may comprise two frame leg sections that are touching or adjacent to vertical and horizontal frame members of a window or door.

Disclosed circular corner elements may comprise a back side that may be attached to a building envelope, a top side that will face toward the exterior of the building, a raised top side or crown section to define circular voids and to give the corner element greater flexibility including torsional flexibility.

Disclosed embodiments include a system of use or construction wherein a building envelope may comprise a plywood substrate or other surface, covered with double D grade paper or other membrane material. The building surface may be wrapped with building wire, sometimes known as "chicken wire" or "lath wire" but is often 1½×17 gauge wire or 3.5 lbs. expanded metal lath.

The next step may include the placement of disclosed circular corner elements at door and window corners, the corner elements secured by fasteners driven through the corner elements with the fasteners passing through the building paper, plywood substrate or other components.

The fastening of a circular corner element as described comports with and even complements building codes that require metal lath to be aptly fastened to the substrate. The additional fasteners used to secure a corner element in no way violates or otherwise compromises the spirit of applicable building codes.

A next step may include the installation of chicken wire or lath wire over the corner elements.

A next step may include the application of a first coat or scratch coat over the building paper, metal lath and corner elements. The material of the scratch coat may penetrate voids of the corner elements. Such voids may include a center void, a plurality of circular voids and circle voids. Dimples may be found upon the topside of the crown section. Subsequent coats may be applied as usual. But, the use of control joints and other prior art methods of crack mitigation may be reduced or eliminated.

Disclosed embodiments encourage the use of stucco systems. Overall the use of stucco has advantages in the art, as a color coat of stucco has integrated color pigment and many stucco applications never need to be repainted. Stucco is also an advantage as stucco is less flammable than traditional wood siding.

REFERENCE NUMERALS IN THE DRAWINGS

100 a corner element in general

Figure 1:
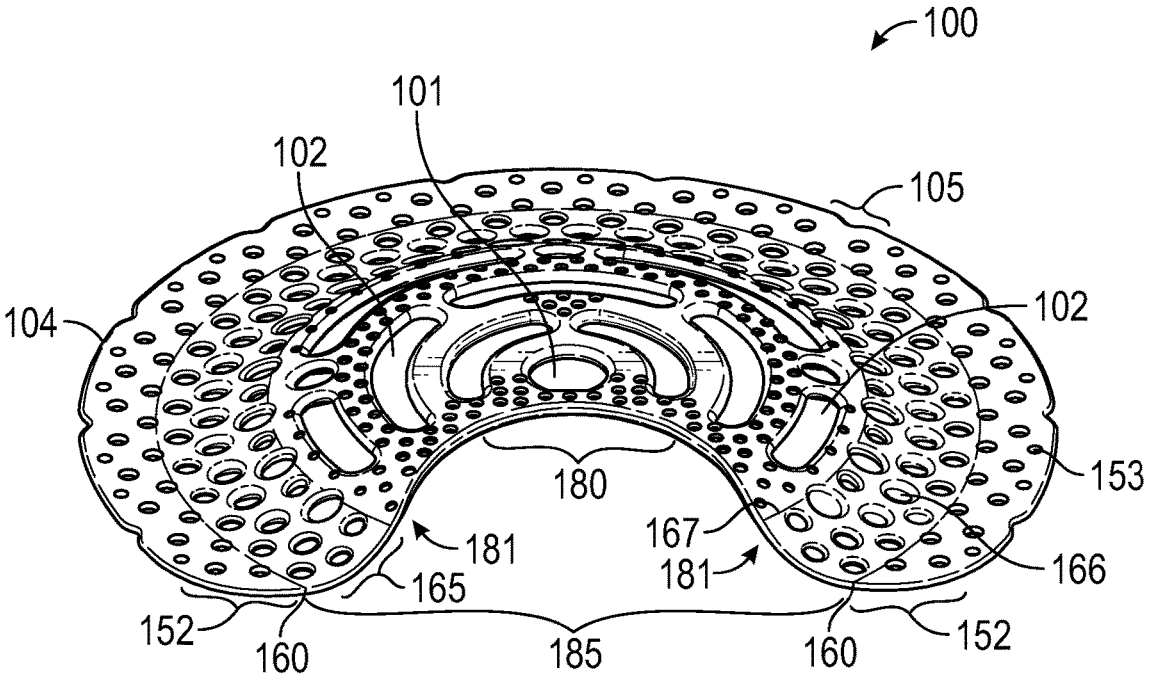
FIG. 1 depicts a front perspective view of a corner element

101 a center void found in a center area of a corner element 100

102 a circular void area defined by a corner element

103 a circle void defined by a corner element and sometimes found between circular void areas 102

104 perimeter edge of a corner element 100

105 outer notch defined by the perimeter edge 104

106 optional flat side of center void, the flat side sometimes adjacent to the center receiving area 180

110 corner element having no pegs

112 corner element having two pegs

120 arc section of a center void 101

122 straight edge or nearly straight edge of center void 101

130 eyebrow void assembly

132 center or horizontal void of eyebrow assembly

134 raised arc or arched bridge of eyebrow void assembly

136 vertically defined void or eyebrow assembly, defined by the raised arc or arched bridge

152 flat outer perimeter area

153 a plurality of circle voids defined within the flat outer perimeter area 152

160 a first transition edge between flat perimeter area 153 and mid concentric transition section 165

165 mid-concentric transition section

166 a plurality of circle voids defined within the mid concentric transition section 165

167 a second transition edge between mid-concentric transition section 165 and crown section 171

171 crown section defined within the second transition edge 167

172 dimples defined within the top side of the crown section

180 a center receiving area of a corner element 100

181 frame leg sections of a corner element 100

185 door and window integration area

190 peg found on bottom side of crown section 171

200 lath wire, also known as chicken wire

300 a window or door frame

301 a horizontal member of a window or door frame

302 a vertical member of a window or door frame

303 a corner point comprising a vertical member 302 and a horizontal member 301 of a window or door frame 300

304 a joint line between a vertical member 302 and a horizontal member 301 of a window or door frame 300

400 an expansion joint of the prior art

401 a window

500 a stucco crack of the prior art

600 exterior stucco surface

650 scratch coat, part of stucco system

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

Referring to FIG. 1, a corner element 100 may comprise a perimeter edge 104 which may define a distal boundary of a flat outer perimeter area 152. For purposes of clarity, components closer to the center void 101 are sometimes considered medial while components closer to perimeter edge 104 are sometimes considered distal.

A flat outer perimeter area 152 assists in placing the corner element securely to a substrate such as plywood or waterproofing membrane. The flat nature of the flat outer perimeter area 152 also assists in balancing with the bottom pegs 190 found under the crown section 171. The flat outer perimeter area may be relatively flat and comprise a plurality of circle voids 153. The flat shape or flat elevation of the flat outer perimeter area may also be helpful in applying frictional force against a substrate. Nails, staples or other fasteners may be applied through the flat outer perimeter area or other parts of the disclosed corner element.

The circle voids 153 of the flat outer perimeter area 152 may be of any shape and assist in the even integration with stucco. The flat outer perimeter area 152 may be used to secure the corner element to a substrate. Nails or other fasteners may be used to secure the corner element to the exterior of a building. The perimeter edge 104 assists in blending the stucco to the surrounding components. The perimeter edge may define a plurality of outer notches 105 which assist in adding surface area to the corner element for greater contact with applied stucco.

A first transition edge 160 may separate the flat outer perimeter area 152 from the mid concentric transition section 165. The mid concentric transition section 165 may take the form of a circular section concentric to the flat outer perimeter area. The mid concentric transition section 165 may gain elevation or cause the corner element to be higher in the medial sections or center sections as compared to the distal sections or outer sections. This raise in height is helpful in integrating the corner element within the center of a stucco application. The elevation may also be helpful in preventing the corner element from being moved during differential building movement.

The mid concentric transition section 165 may comprise a plurality of circular voids 166 of any shape. The circular voids 166 may have a somewhat vertical or near vertical orientation and thus assist with integration with stucco at various elevations or stucco depths. The angled circular voids 166 may also assist in more evenly displacing differential building movement within or along the corner element. The angle of the mid concentric transition section 165 allows for three dimensional flexing to further dissipate differential building movement.

Figure 5:
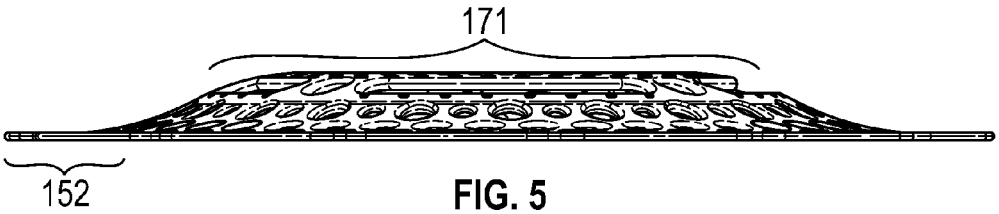
FIG. 5 depicts a left side view of a corner element

Areas medial or more center from the mid concentric transition section may be considered a crown section 171 as marked more clearly on FIG. 5. A crown section may comprise a top side further comprising dimples 172 which may take the form of indentations. The dimples 172 allow for keying of the stucco to the corner element which helps in keeping the corner element firmly in place within applied stucco. Also, the dimples 172 increase the surface area of the exposed corner element, assisting in securing the corner element in the stucco. Moreover, the dimples help to keep the stucco from sliding off the corner element during the stucco drying process. The crown section 171 may comprise or define a plurality of circular void areas 102 which helps to allow wet stucco or mud to flow between the top and bottom sides of the corner element. The circular void areas 102 may be circular or concentric in shape. The circular shapes of the circular void areas helps the corner element to flex along a greater area which in turn helps to maximize the even disbursement of uneven building movements at corners. Center void 101 may act as a focal point to radiate or absorb differential building movement in a radial fashion to the distal areas of the corner element. A center receiving area 180 flanked by two frame leg sections 181 assist in placing the corner element in a corner area of construction. The area spanning the two frame leg sections 181 and the center receiving area 180 is sometimes referred to as the door and window integration area 185.

Figure 2:
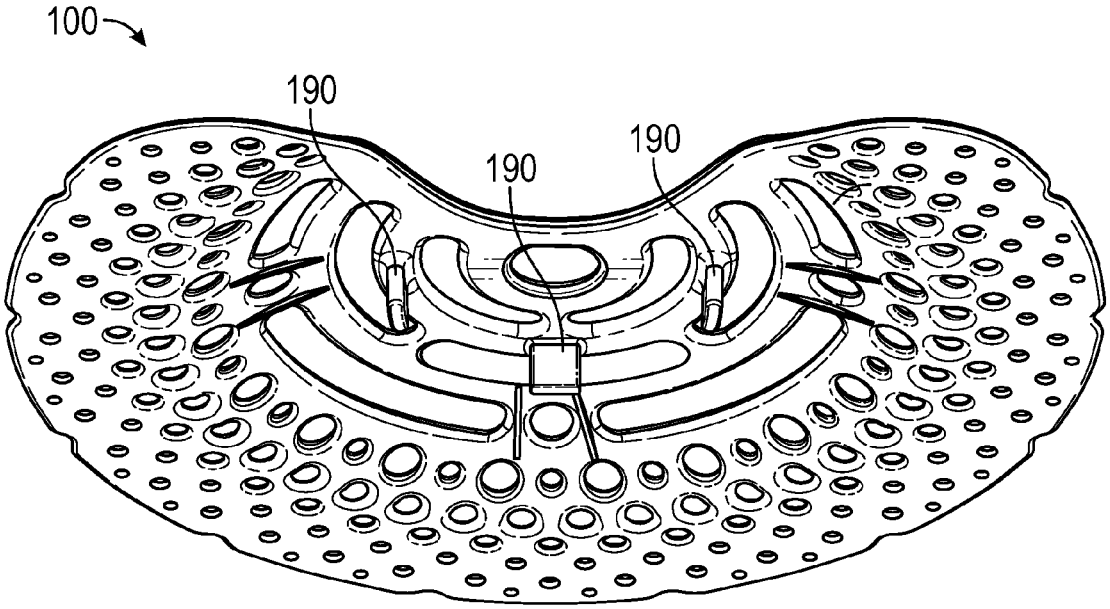
FIG. 2 depicts a back perspective view of a corner element

FIG. 2 depicts a plurality of pegs attached to the bottom side of the crown section of the corner element.

Figure 3:
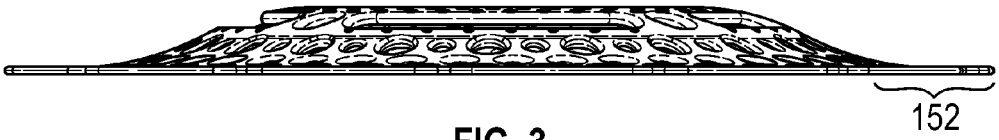
FIG. 3 depicts a front side view of a corner element

FIG. 3 depicts a flat outer perimeter 152 from a side perspective.

Figure 4:
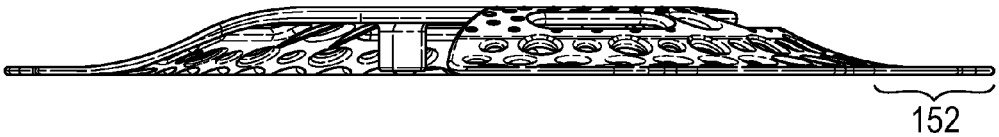
FIG. 4 depicts a back side view of a corner element

FIG. 4 depicts a flat outer perimeter 152 from a side perspective.

FIG. 5 depicts a crown section 171 from a side perspective.

Figure 6:
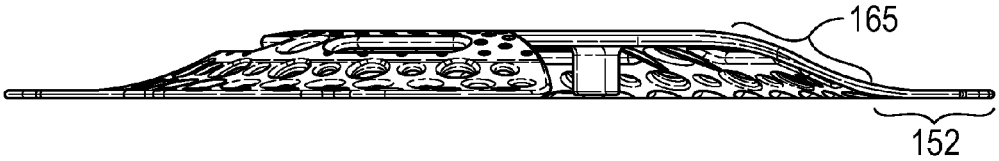
FIG. 6 depicts a right side view of a corner element

FIG. 6 depicts a mid-concentric transition section from a side perspective.

Figure 7:
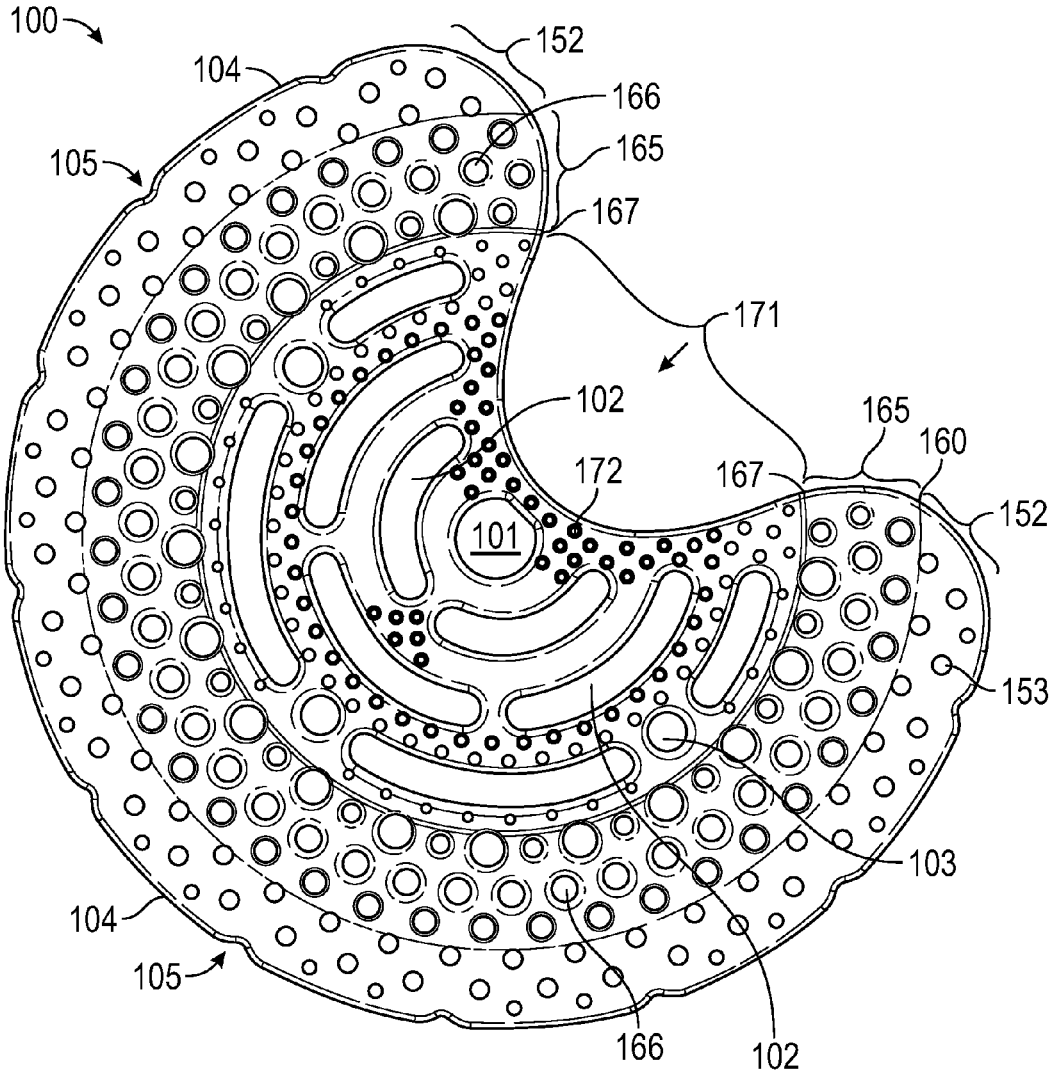
FIG. 7 depicts a top side view of a corner element

FIG. 7 depicts a top side view of a corner element 100. A corner element may have a perimeter edge 104 that may define a plurality of outer notches 105. A flat outer perimeter area 152 may be found between the perimeter edge 104 and the first transition edge 160. The flat outer perimeter area may comprise or define a plurality of voids, such as circle voids 153. The flat outer perimeter area may have a top side and bottom side, and the bottom side may be considered to have a zero or neutral elevation.

A mid-concentric transition section 165 may be considered to have a positive or increased elevation, having an elevation greater than the flat outer perimeter area 152. The mid-concentric transition section 165 may be found or defined between the first transition edge 160 and a second transition edge 167. The mid-concentric transition section may define a plurality of voids, such as circle voids 166.

Areas medial from the second transition edge 167 may comprise a crown section 171. A crown section may be flat near the center void 101 so as to sit in a mid-depth of applied stucco. A crown section 171 may comprise or define a plurality of circular void areas 102 which may take the shape of voids concentric to the center void 101. Areas of the crown section 171 may comprise dimples 172.

FIG. 7 further depicts a plurality of circular void areas 102 defined by or defined within a corner element 100. Circular void areas 102 aid in the reduction of stucco cracks by a number of physical factors. In some embodiments, circular void areas 102 sometimes take the shape of partial concentric circles with a center point found within a center void 101. The concentric configuration of circular voids 102 results in areas of stucco attachment and support perpendicular to the typical stucco cracks originating at doors and windows. The concentric configuration of the circular voids 102 more evenly dissipates movement of stucco and thus greatly reduces resulting cracks. The concentric configuration of the circular voids 102 results in a stucco base coat or scratch coat entering the circular voids and integrating into the corner element.

In order to retain a correct combination of rigidity and flexibility, circular voids 102 are defined on either end by corner element material. For added flexibility and absorption of stucco movement, circle voids 103 are sometimes placed between circular voids 102.

Figure 8:
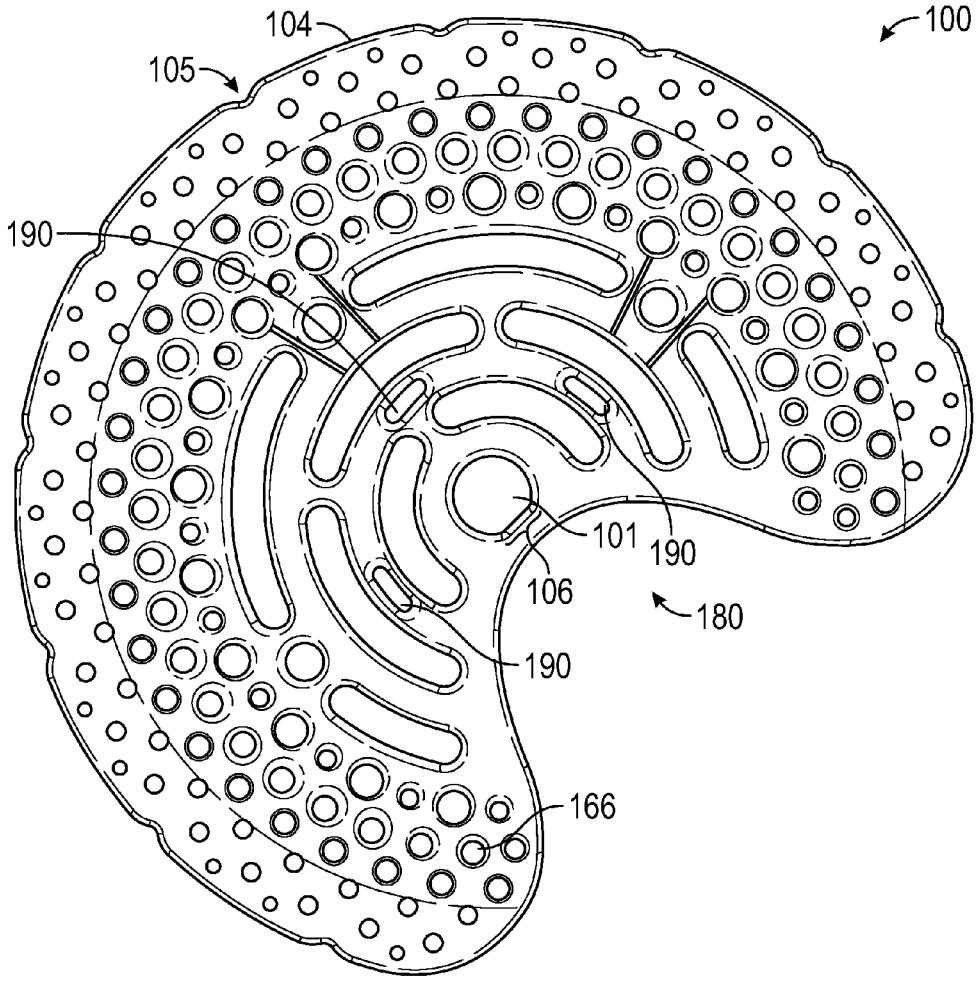
FIG. 8 depicts a bottom side view of a corner element

FIG. 8 depicts a plurality of pegs 190 and a center void 101. The center void 101 is shown with an optional flat side 106, the flat side toward the center receiving area 180. The flat side 106 may help to laterally dissipate building movement to either side of the frame legs.

Figure 9:
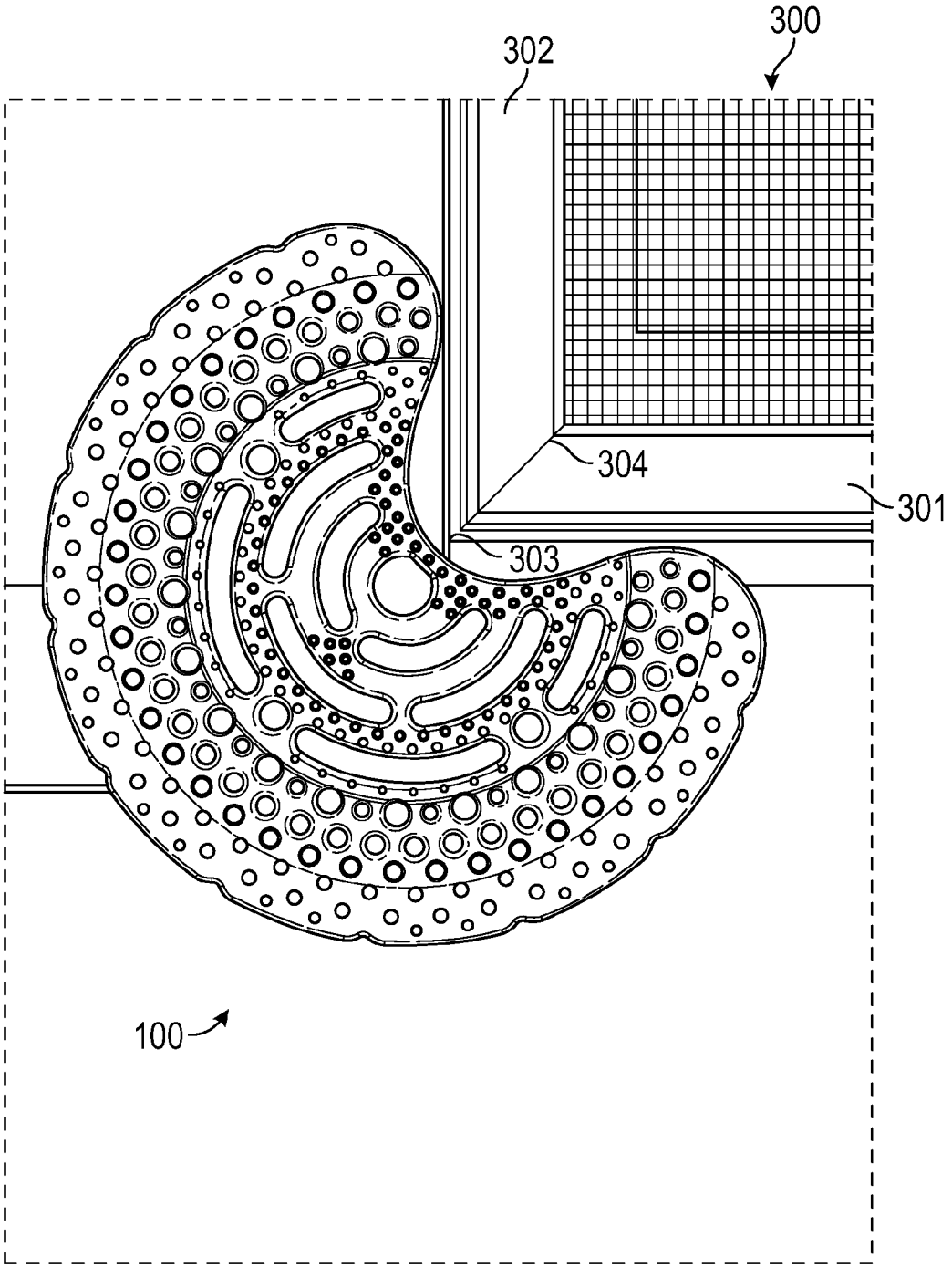
FIG. 9 depicts a corner element in position before the installation of metal lath

FIG. 9 depicts a window or door frame 300 is adjacent to or in contact with the corner element 100. The window or door frame may comprise a horizontal member 301, a vertical member 302 and a joint line 304, the joint line defined by the connection line shared by the horizontal member 301 and the vertical member 302. At the outer edge of the joint line 304, a corner point 303 is formed. The corner element 100 is illustrated as attached over lath wire 200.

Figure 10:
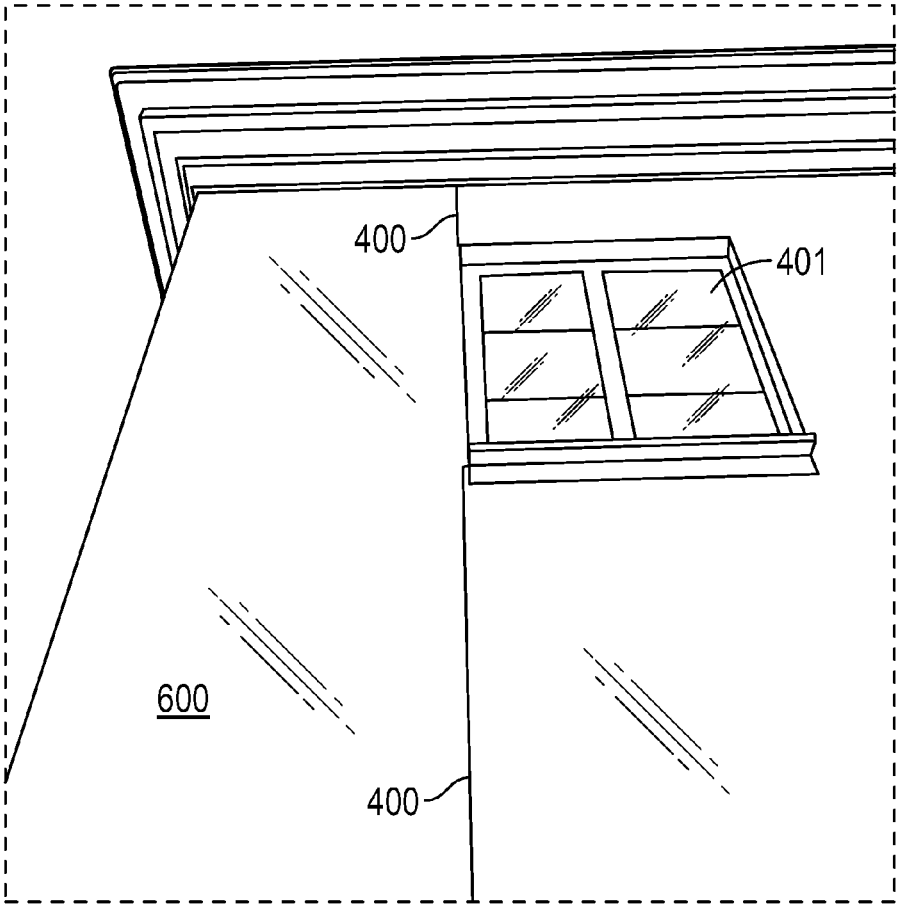
FIG. 10 (Prior Art)
FIG. 10 depicts an expansion joint of the prior art

FIG. 10 depicts a building comprising a window 401 with a vertical expansion joint 400 of the prior art. The vertical expansion joint 400 of the prior art detracts from the esthetic appeal of using stucco as an exterior covering.

Figure 11:
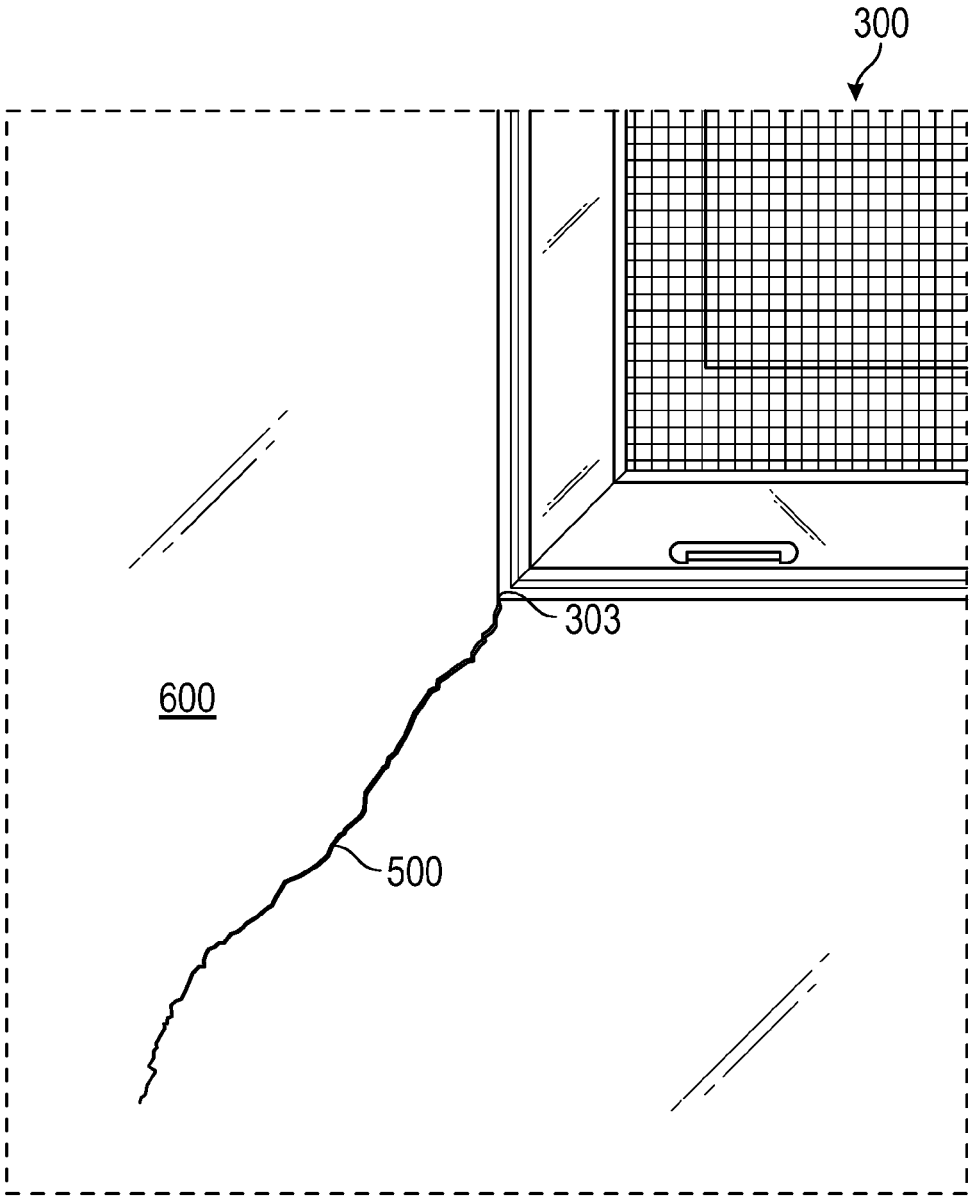
FIG. 11 (Prior Art)
FIG. 11 depicts a corner crack of the prior art

FIG. 11 depicts a stucco crack 500 originating at a corner point 303 of a window or door frame 300. The stucco crack 500 is seen upon the exterior stucco surface 600.

Figure 12:
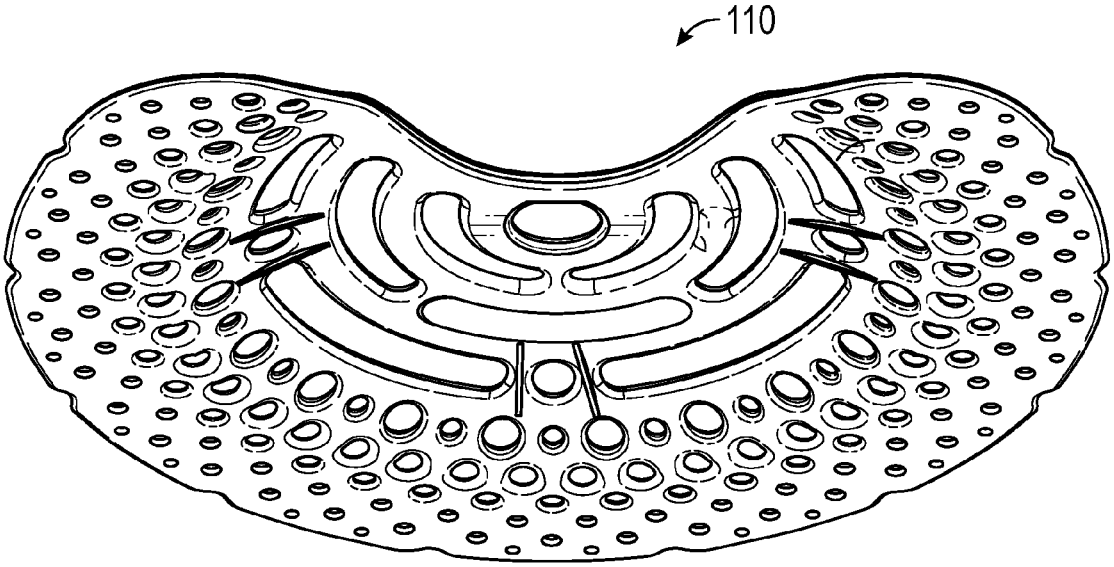
FIG. 12 depicts a bottom perspective view of a corner element

FIG. 12 depicts a corner element 110 not having pegs. Disclosed embodiments contemplate zero, one or a plurality of pegs. In some applications, pegs help to set the corner element into the stucco system. Pegs may also provide vertical support as the corner element is fastened, screwed, stapled or nailed into a substraight such as plywood or other building sheathing.

Figure 13:
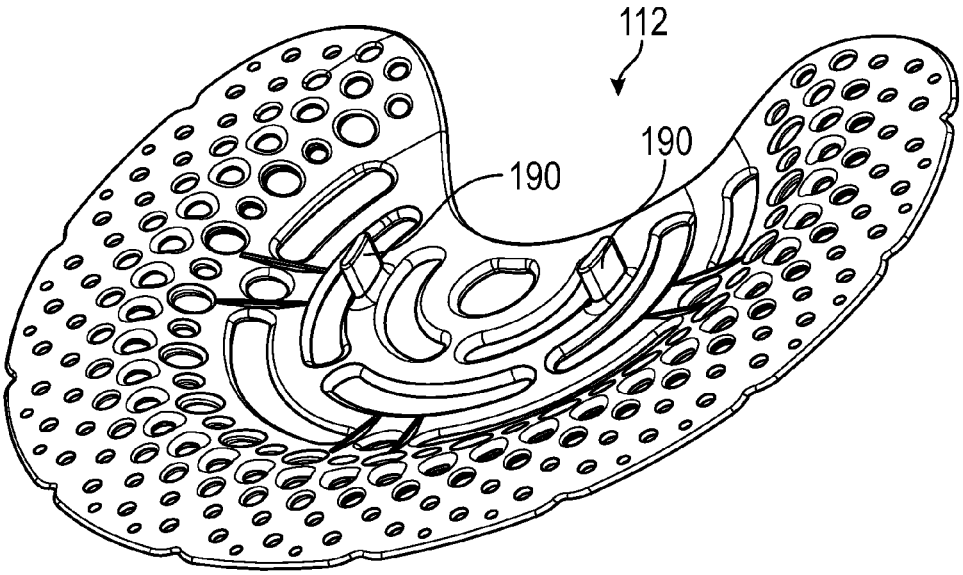
FIG. 13 depicts a bottom perspective view of a corner element with two pegs

FIG. 13 depicts a corner element having two pegs 190.

Figure 14:
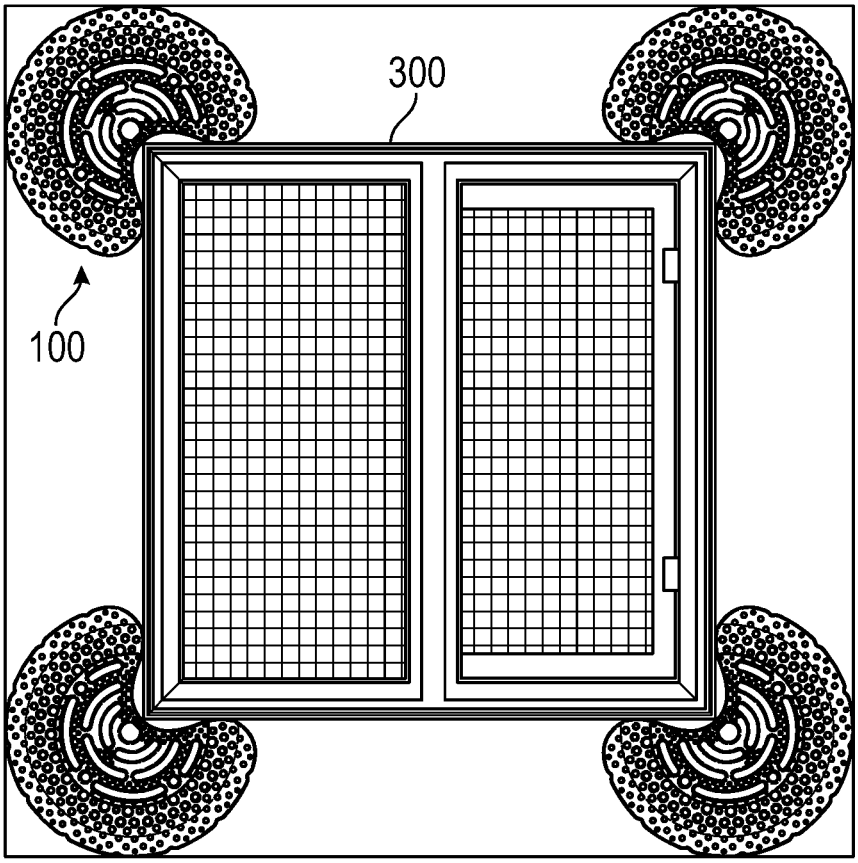
FIG. 14 depicts four corner elements attached next to a widow

FIG. 14 depicts a window 300 with four corner elements 100 attached near the window corners.

Figure 15:
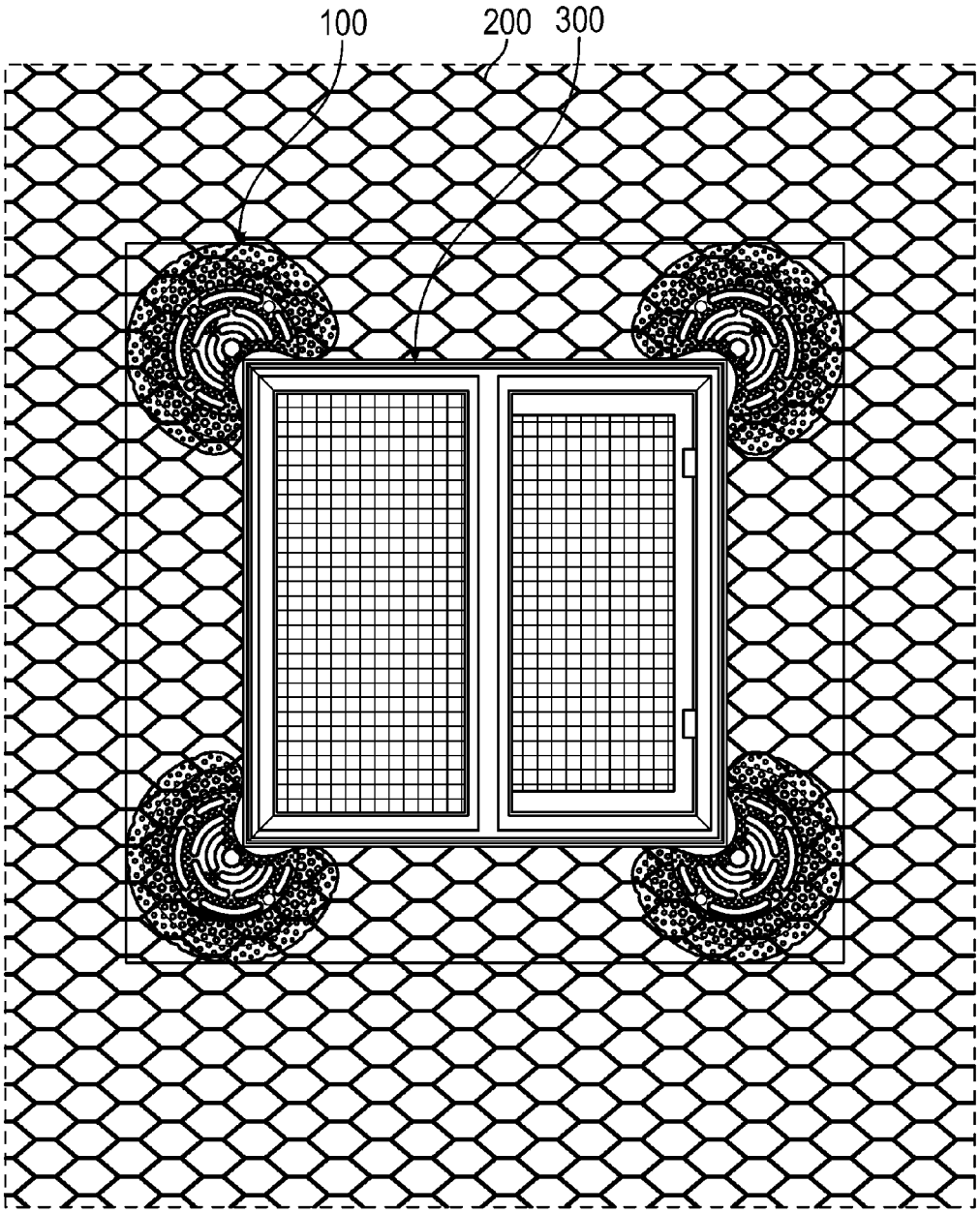
FIG. 15 depicts four corner elements under chicken wire

FIG. 15 depicts a continuation of FIG. 14 with chicken wire or lath wire 200 placed over the corner elements 100.

Figure 16:
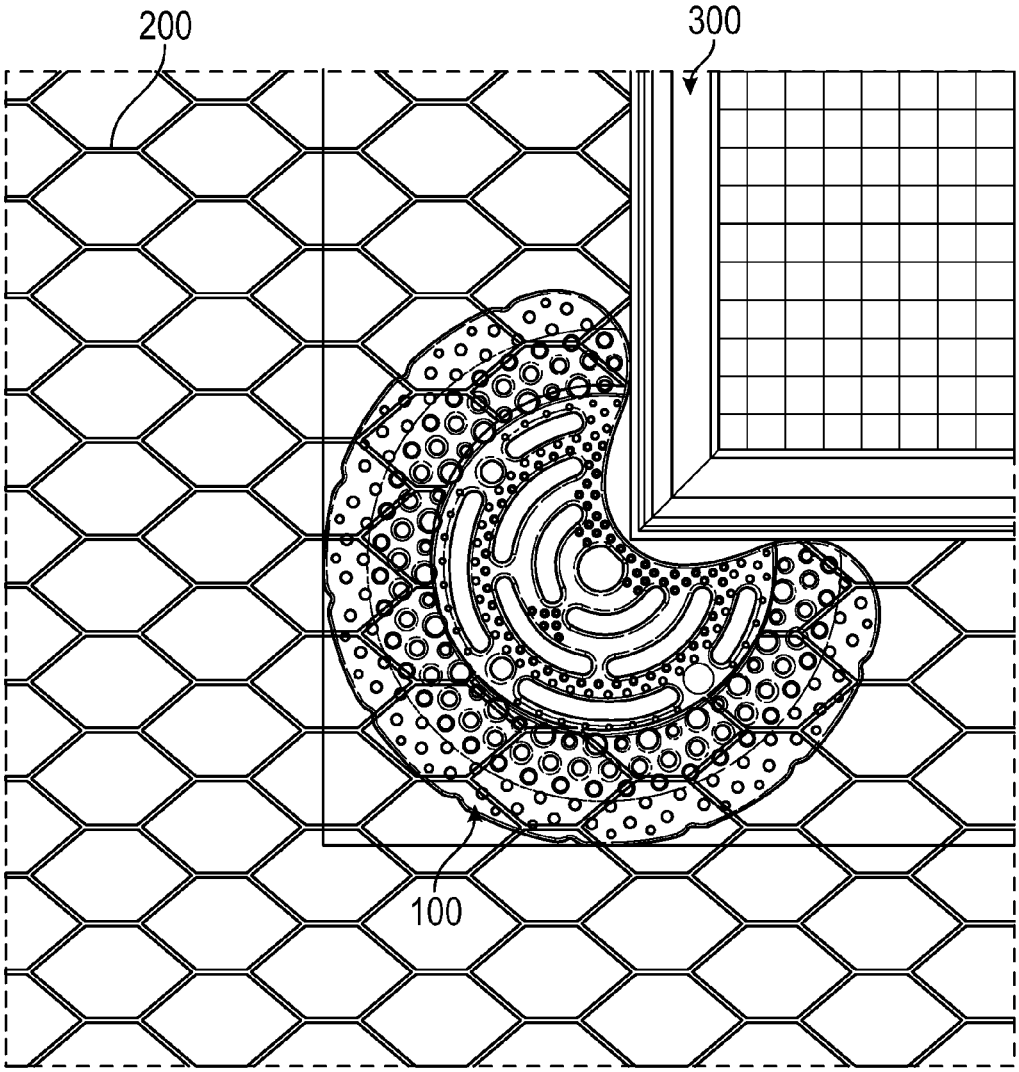
FIG. 16 depicts one corner element under chicken wire

FIG. 16 is an expanded view of FIG. 15 wherein chicken wire or lath wire 200 is attached on top of a corner element 100 and the corner element has been attached near, touching or adjacent to a window 300 and in particular a window corner.

Figure 17:
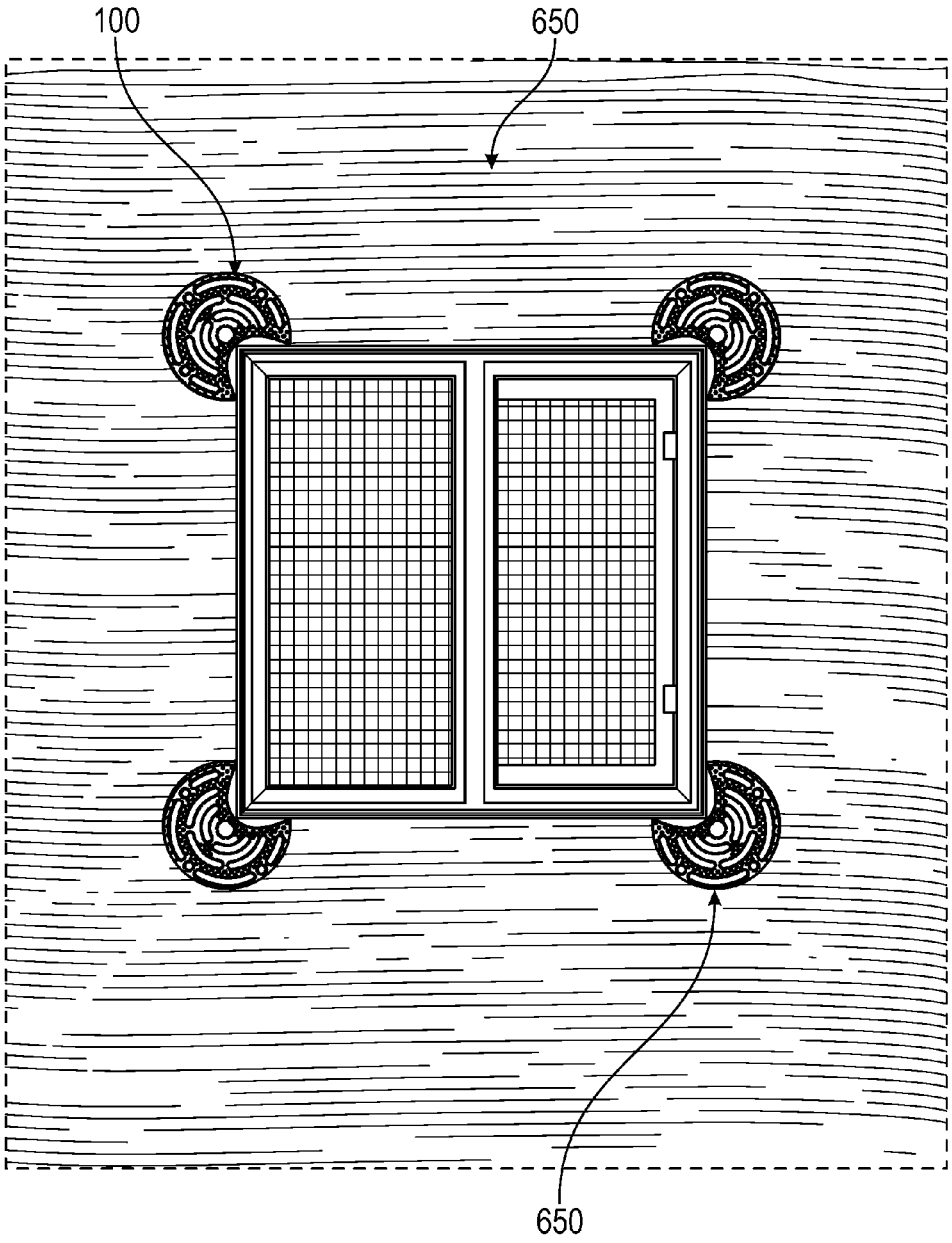
FIG. 17 depicts four corner elements within a scratch coat
Figure 18:
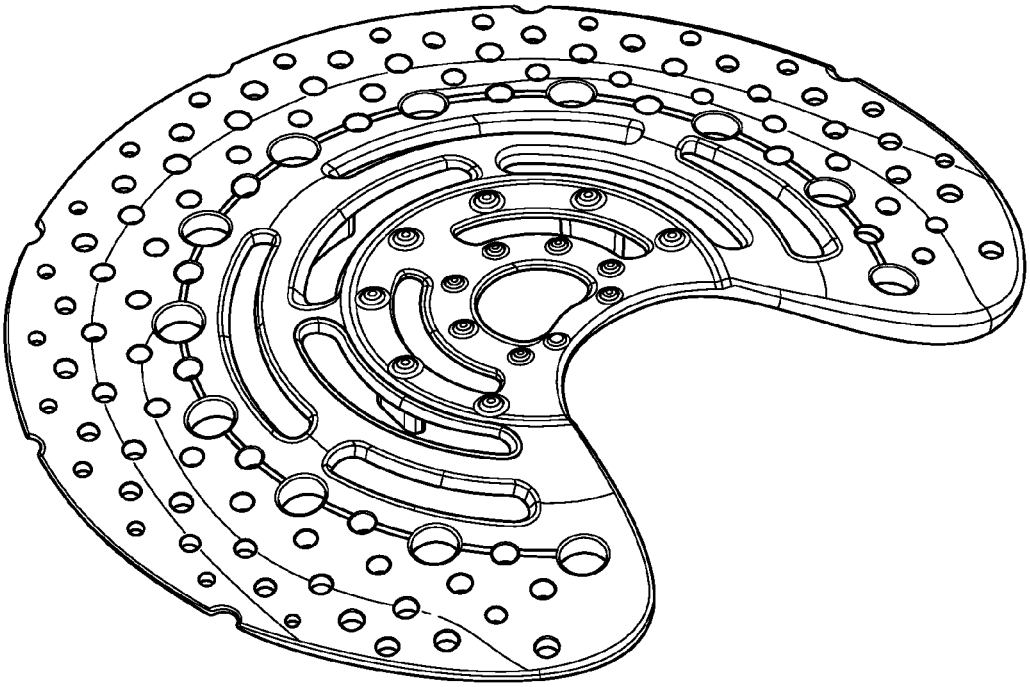
FIG. 18 depicts a perspective view of an alternative embodiment
Figure 19:
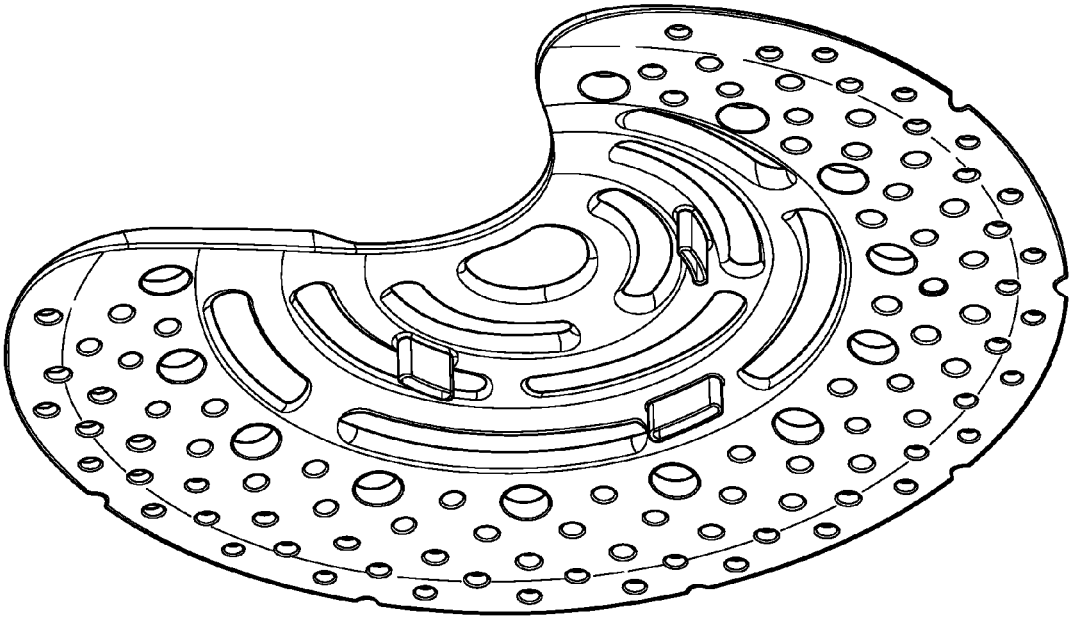
FIG. 19 depicts a perspective view of an alternative embodiment
Figure 20:
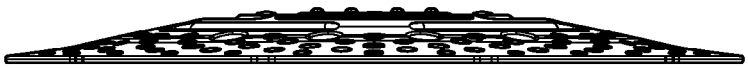
FIG. 20 depicts a side view of an alternative embodiment
Figure 21:
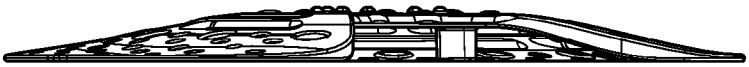
FIG. 21 depicts a side view of an alternative embodiment
Figure 22:
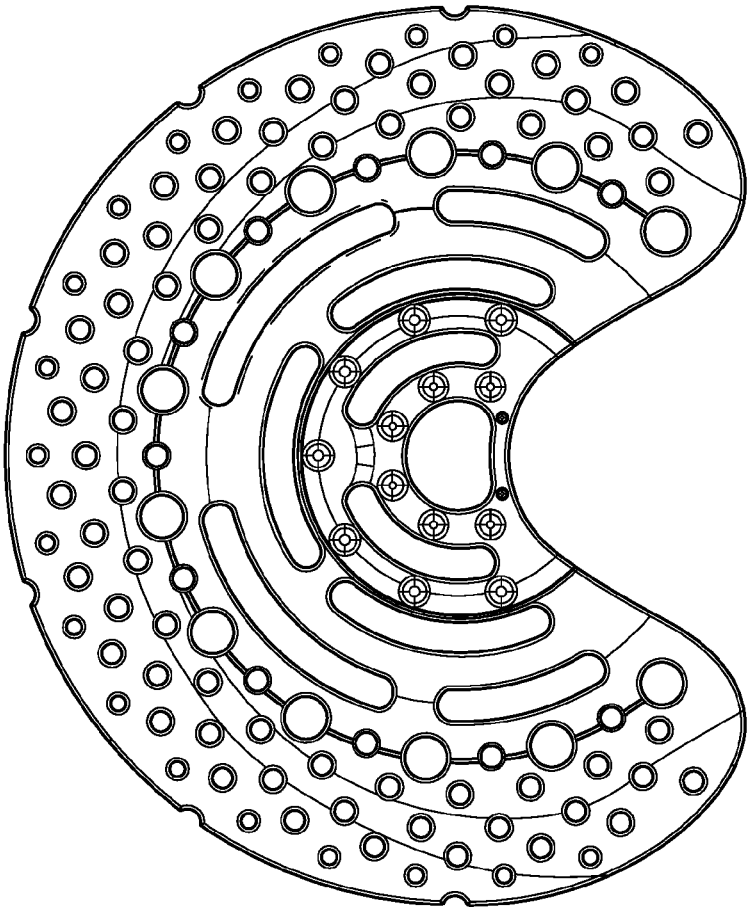
FIG. 22 depicts a top view of an alternative embodiment
Figure 23:
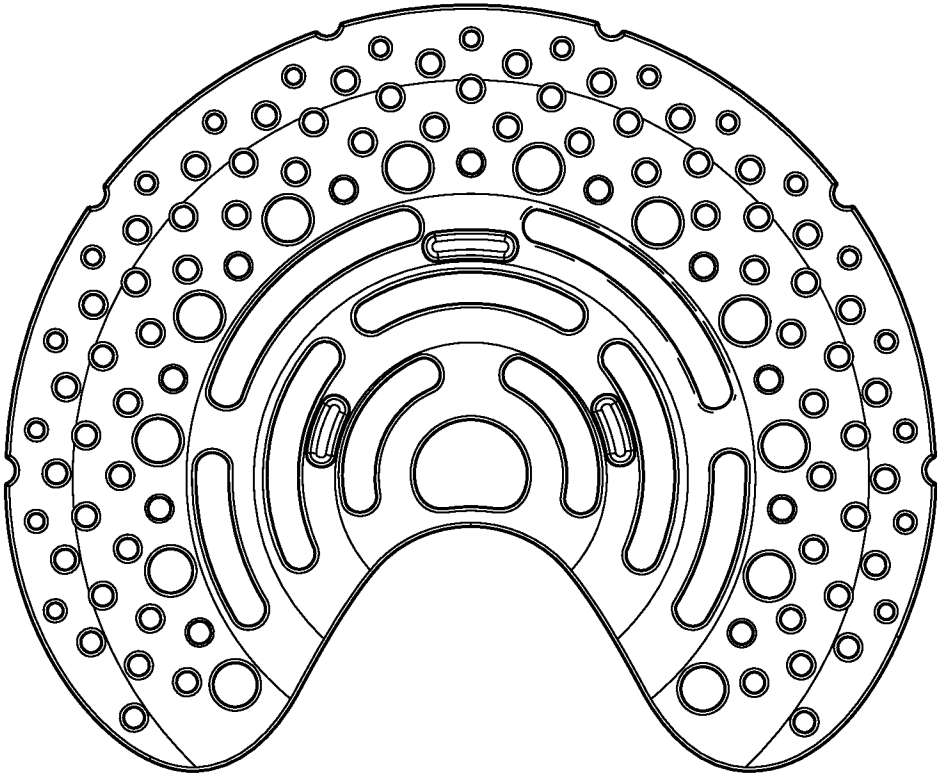
FIG. 23 depicts a bottom view of an alternative embodiment

FIG. 17 is a modified view of scratch coat 650 applied over and covering chicken wire or lath wire and covering the four corner elements. The view is modified in that the scratch coat 650 is embedded into the voids of the corner elements, obscuring the view of the corner elements. In a more realistic rendering, the corner elements would be difficult to see due to the application of the scratch coat 650.

Advantages in preventing or reducing stucco cracks are also found by the relatively lower elevation of the flat corner perimeter area 152. By use of a lower elevation of the outer or distal surface a more direct attachment may be obtained with an underlying substrate.

Advantages in preventing or reducing stucco cracks are also found by having a raised top surface or crown section 171, sometimes having a relatively higher elevation and thickness as compared to the flat outer perimeter area 152. The higher elevation of the raised crown section allows for added material to define and support the center void 101, the circular void areas 102 and the circle voids 103. The added depth by use of a raised crown section may also assist in giving the corner element an ability to flex in areas between areas used for attachment to a substrate.

A corner element may also comprise artful integration with a door or window corner section by use of a door or window integration area 185. The integration area 185 may comprise two frame leg sections 181 with each frame leg section starting at a perimeter edge 104 and terminating at or near a center receiving area 180. A center receiving area 180 may be centered upon a center void 101. A center receiving area 180 is sometimes curved so as to further disburse stucco movement at a window or door corner. The center receiving area 180 may flex left, right, up or down to further dissipate the buckling forces commonly encountered by stucco at door and window corners. Also the door and window integration area 185 provides advantages in that it may also flex left, right, up or down to further dissipate the buckling forces commonly encountered by stucco at door and window corners.

The center receiving area 180 is sometimes configured to be adjacent or relatively near the center void 101 or center area of the corner element. Such a configuration provides rotational support and retardation of movement in directions perpendicular to common stucco cracks at doors and windows. Such a common stucco crack 500 is seen in FIG. 9.

In the best mode known to date, a corner element 100 is comprised of high density polyethylene. Such material is semi-rigid, allowing for an optimal degree of flexibility to evenly disperse stucco movement. The material is strong enough to provide further stucco support and reinforcement when the corner element is embedded in plaster. In the best mode known to date, the corner element height is $2/5^{ths}$ of an inch in width such that the corner element is embedded in approximately the center of a $7/8^{ths}$ of an inch stucco application.

Further advantages of the disclosed embodiments include the use of smooth rolled edges and circular lines which redistribute stress or stucco movement or compression evenly over the corner element and related components. A configuration of concentric circular voids in the shape of slots originates from the center with each concentric circular void distal from the center point, resulting in concentric circular voids or concentric slots positioned at right angles to the corner section of a door or window.

FIGS. 18 to 23 depict an alternative embodiment or a second embodiment having the same or similar attributes and advantages of the other disclosed embodiments.

Figure 24:
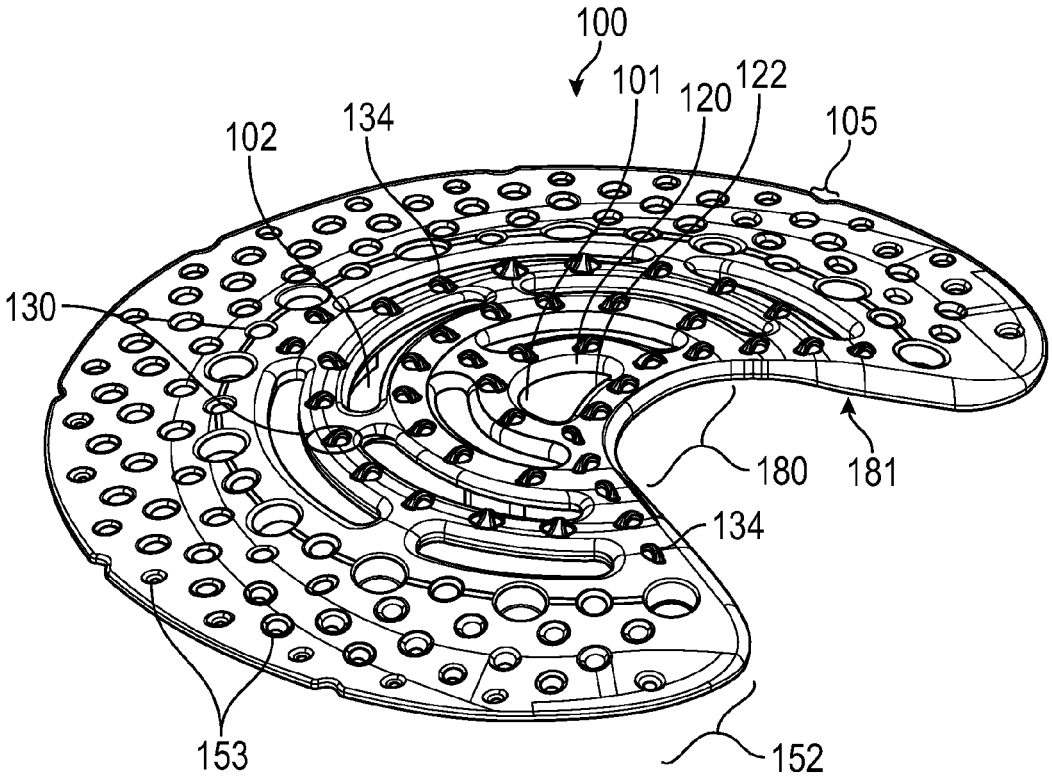
FIG. 24 depicts a top perspective view of a third embodiment
Figure 25:
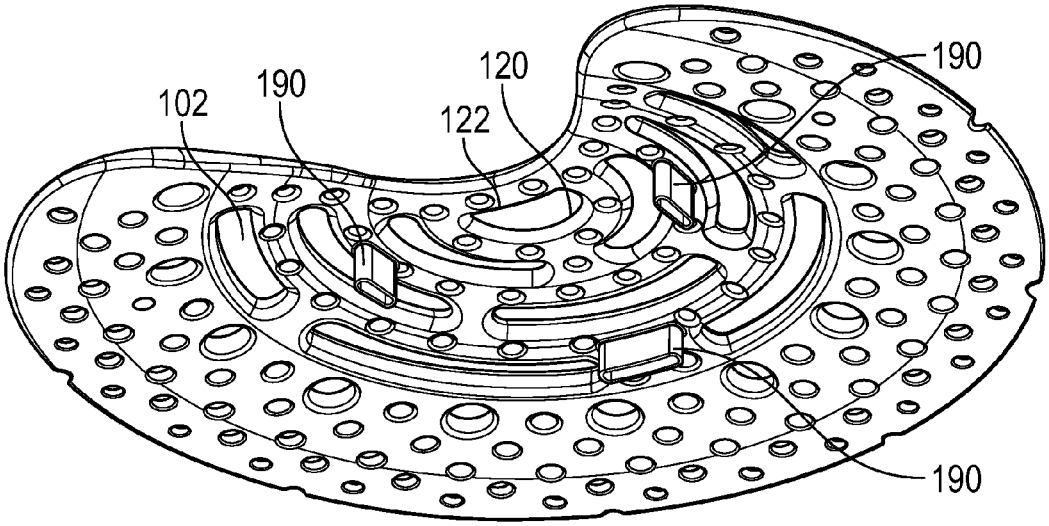
FIG. 25 depicts a bottom perspective view of a third embodiment
Figure 26:
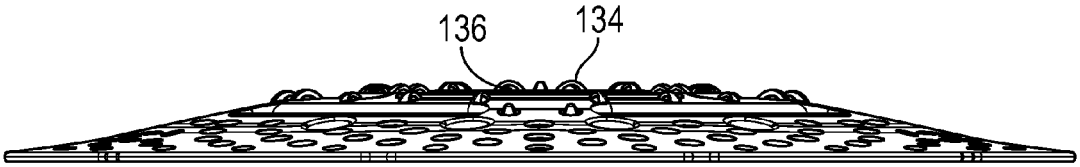
FIG. 26 depicts a front view of a third embodiment
Figure 27:
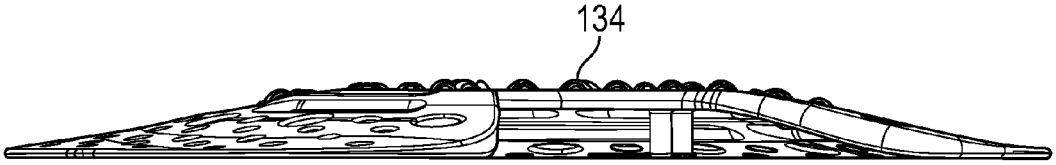
FIG. 27 depicts a back side view of a third embodiment

FIG. 24 depicts a third embodiment having a plurality of eyebrow void assemblies 130, the eyebrow void assemblies comprising a horizontally disposed center or horizontal void. A raised arc 134 may be centrally disposed over a horizontal void, with the raised arc 134 defining a vertically defined void 136.

The disclosed eyebrow assembly represents a significant breakthrough in the art, as the stucco cracks are eliminated or greatly reduced as the raised arc 134 is able to adhere within the stucco significantly better as compared to the first and second embodiments herein. The raised arc 134 placed over a horizontal void 132 allows the corner element to embed in the stucco in three dimensions, producing improved results over the prior art and over the first two embodiments disclosed herein. The eyebrow assemblies may be located or defined anywhere upon or within a corner element.

Figure 28:
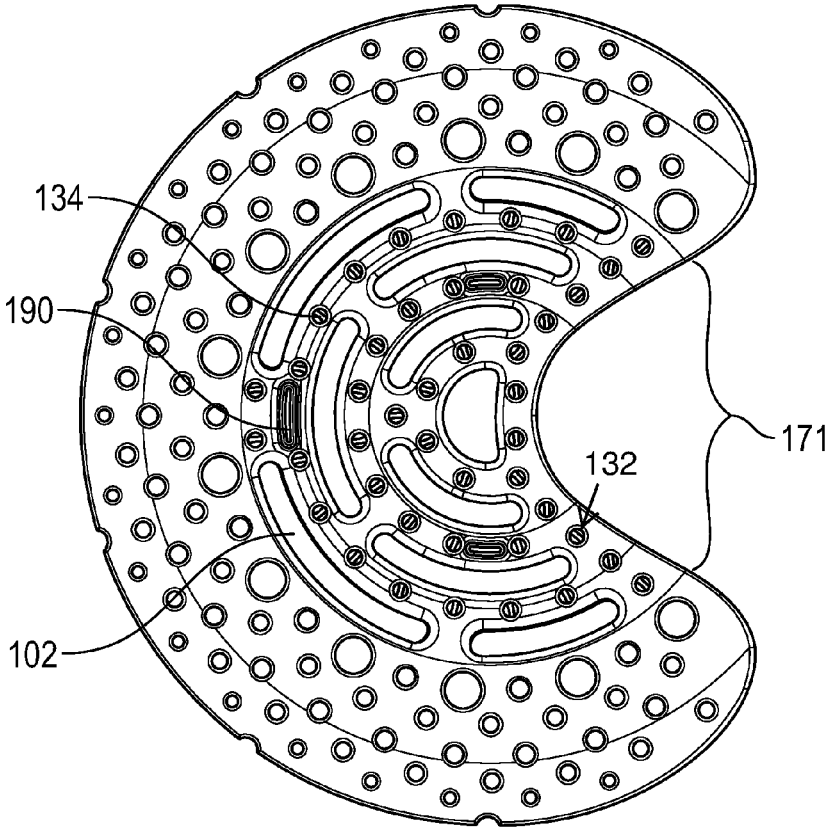
FIG. 28 depicts a bottom plan view of a third embodiment
Figure 29:
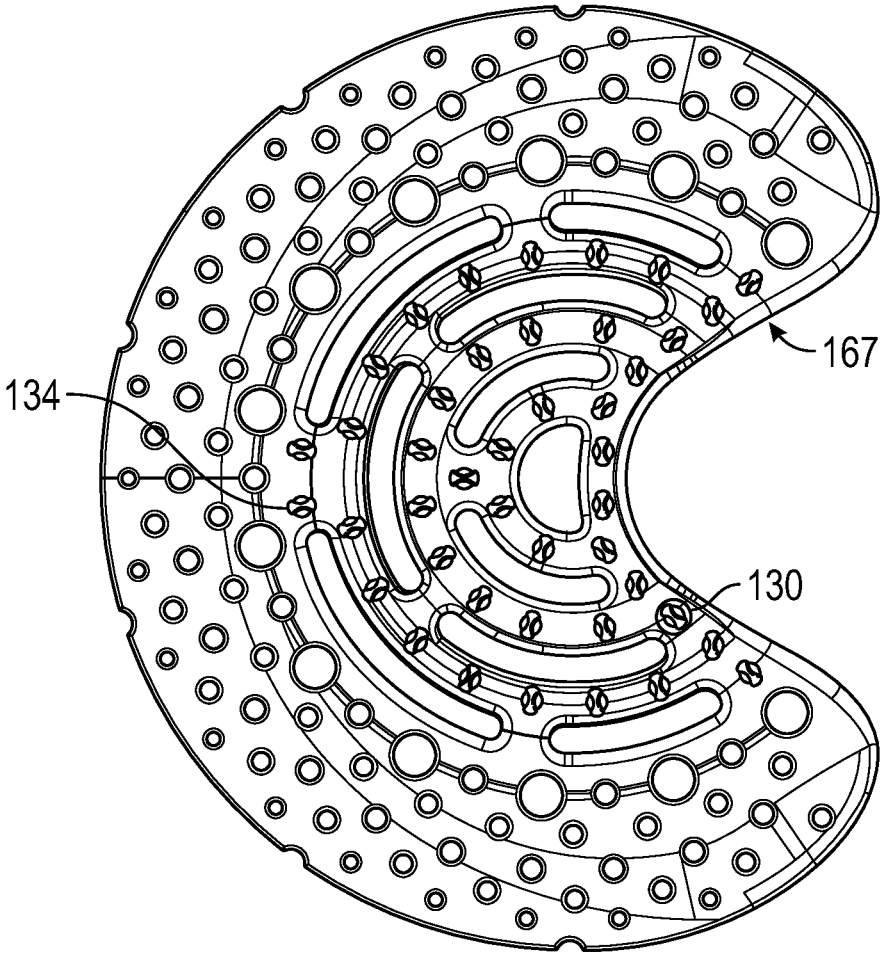
FIG. 29 depicts a top plan view of a third embodiment

In the depicted third embodiment, starting at FIG. 24, the eyebrow assemblies are illustrated to be disposed in the upper elevations of the element and sometimes above a second transition edge 167, as shown in FIG. 29. Eyebrow assemblies are found or defined within or above a crown section 171, as marked on FIG. 28. FIG. 28 depicts a center or horizontal void 132 of an eyebrow assembly. The horizontal void 132 overcomes shortfalls in the art by providing a stucco retention area at a right angle to the stucco retention area comprising the vertically defined void 136 of the raised arc 134 or raised arch.

Figure 30:
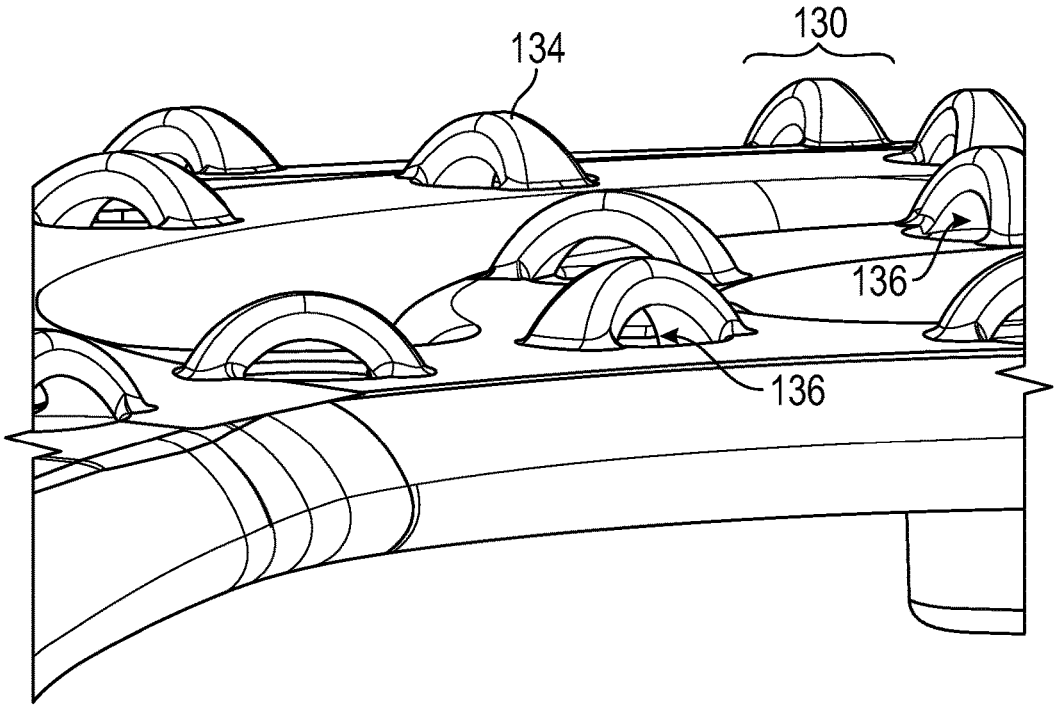
FIG. 30 depicts an enlarged view of eyebrow void assemblies

FIG. 30 depicts a perspective view of several eyebrow assemblies 130 which may comprise an arched bridge 134 or raised arc, with the arched bridge defining a vertically defined void 136. The unique shape and configuration of the eyebrow assembly overcomes shortfalls in the art as the vertically defined void 136 retains dried stucco and allows the overall corner element to stay retained in the stucco and thus better deflect or disperse differential stucco movement to reduce stucco cracks.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms. Disclosed embodiments may include the following items.

Items

Item 1. A system to reduce stucco cracks, the system comprising:

a corner element 100 having a top side, bottom side, a circular outer edge defined by a perimeter distal edge 104 and two frame leg sections 181.

Item 2. The system of 1 further comprising:

a door and window integration area 185 comprising the two frame leg sections and a center receiving area 180 located between the two frame leg sections.

Item 3. The system of item 2 further comprising a flat outer perimeter area 152 defined between the perimeter distal edge and a first transition edge 160, the first transition edge in the shape of a concentric circle.

Item 4. The system of item 3 further comprising a mid-concentric transition section defined between the first transition edge and a second transition edge 167, the second transition edge in the shape of a concentric circle.

Item 5. The system of item 4 wherein the mid-concentric transition section is radially arched in shape having a higher elevation at the second transition edge as compared to the first transition edge.

Item 6. The system of item 5 further comprising a crown section 171 defined as the area within the second transition edge.

Item 7. The system of item 6 wherein the crown section comprises a center void 101.

Item 8. The system of item 7 wherein the crown section comprises a plurality of pegs originating from the bottom side.

Item 9. The system of item 8 wherein the bottom edges of the legs extend to a plane level with the bottom side of the flat outer perimeter area.

Item 10. The system of item 8 wherein the perimeter distal edge defines a plurality of outer notches 105.

Item 11. The system of item 10 wherein the flat outer perimeter area defines a plurality of circle voids 153.

Item 12. The system of item 11 wherein the mid-concentric transition section defines a plurality of circle voids 166.

Item 13. The system of item 12 wherein the crown section defines a plurality of circular void areas 102.

Item 14. The system of item 13 wherein the top side of the crown section defines a plurality of dimples 172.

Item 15. The system of item 14 wherein the center void is further defined by a flat side 106, the flat side adjacent to the center receiving area.

Item 16. A method of reducing stucco cracks, the method comprising:

a) attaching a corner element 100 at a corner point 303 of a door or window; and b) applying a coat of stucco material over the corner element 100.

Item 17. The method of item 16 including the step of filling voids of the corner element with the stucco coat.

Item 18. The method of item 16 including the step of securing the corner element 100 by use of a plurality of fasteners set through the corner element.

What is claimed is:

1. A system to reduce stucco cracks, the system comprising:

a corner element having a top side, bottom side, a circular outer edge defined by a perimeter distal edge and two frame leg sections, the corner element further comprising;

a) a door and window integration area comprising the two frame leg sections and a center receiving area located between the two frame leg sections, the center receiving area configured to receive a window or door frame corner;

b) a flat outer perimeter area defined between the perimeter distal edge and a first transition edge, the first transition edge in a shape of a concentric circle;

c) a mid-concentric transition section defined between the first transition edge and a second transition edge, the second transition edge in the shape of a concentric circle;

d) the mid-concentric transition section is radially arched in shape having a higher elevation at the second transition edge as compared to the first transition edge;

e) a crown section defined as an area within the second transition edge comprises a center void (101);

f) the crown section defines a plurality of eyebrow assemblies (130), each eyebrow assembly defines a horizontal void (132) and comprises an arched bridge (134) centrally disposed over the horizontal void, with the arched bridge defining a vertically defined void (136);

g) the crown section comprises a plurality of pegs originating from a bottom side.

2. The system of claim 1 wherein bottom edges of the pegs extend to a plane level with a bottom side of the flat outer perimeter area.

3. The system of claim 1 wherein the perimeter distal edge defines a plurality of outer notches.

4. The system of claim 1 wherein the flat outer perimeter area defines a plurality of circle voids.

5. The system of claim 1 wherein the mid-concentric transition section defines a plurality of circle voids.

6. The system of claim 1 wherein the crown section defines a plurality of circular void areas.

7. The system of claim 1 wherein a top side of the crown section defines a plurality of dimples.

8. The system of claim 1 wherein the center void is further defined by a flat side, the flat side adjacent to the center receiving area.

9. A method of reducing stucco cracks, the method comprising:

a) attaching the corner element of claim 1 at a corner point of a door or window; and b) applying a coat of stucco material over the corner element.

10. The method of claim 9 including a step of filling a plurality of voids of the corner element with the stucco coat.

11. The method of claim 9 including a step of securing the corner element by use of a plurality of fasteners set through the corner element.

* * * * *